US005494346A

United States Patent [19]

Domenig

[11] Patent Number: 5,494,346

[45] Date of Patent: Feb. 27, 1996

[54] ADJUSTABLE SHELF ASSEMBLY

[75] Inventor: Georg Domenig, Kernersville, N.C.

[73] Assignee: Peter Meier, Inc., Kernersville, N.C.

[21] Appl. No.: 289,623

[22] Filed: Aug. 12, 1994

[51] Int. Cl.[6] ..... A47B 81/00

[52] U.S. Cl. ..... 312/238; 403/322

[58] Field of Search ..... 312/238, 326; 248/507, 200.1, 231.2; 135/131, 145, 114; 403/321, 322

[56] References Cited

U.S. PATENT DOCUMENTS

| | | | |
|---|---|---|---|
| 693,159 | 2/1902 | Rumbarger | 403/322 X |
| 1,944,748 | 1/1934 | Leach | 403/322 X |
| 2,598,970 | 6/1952 | Buttrick | 248/200.1 |
| 4,181,037 | 1/1980 | Boon et al. | 297/238 X |
| 4,433,885 | 2/1984 | Baker | 297/238 X |
| 4,439,054 | 3/1984 | Veronesi | 403/322 |

*Primary Examiner*—Kenneth J. Dorner
*Assistant Examiner*—David E. Allred

[57] ABSTRACT

An adjustable shelf assembly wherein a vertical post rotatably mounted in a cabinet supports a plurality of rotatable shelves which carry the cabinet door. To enable the post and the door to be adjusted vertically, a lower bearing element has a slide member affixed to and rotatably movable with the post and having a downwardly inclined ramp on its upper end. A pivotally secured bearing member is positioned within and pivotally secured to the post and, when experiencing pivotal movement, moves back and forth relative to the inclined ramp. A screw is threadably received by the bearing member within the post and extends outside thereof to enable manual adjustment. The slide member, bearing member and screw are arranged so that the screw is adjustably accessible when a portion of the door is within the cabinet door opening to provide direct visual door adjustment within the door opening. The lower bearing element has a vertical slot extending transverse of its longitudinal axis to accommodate a locking pin, the slot having a sufficient vertical opening to enable the post to move upwardly and downwardly with respect to the lower bearing element as the bearing member is pivotally displaced and is moved upwardly or downwardly to displace the post. A plurality of securing apertures are provided for locking the slide member in a fixed relationship with the vertical post.

18 Claims, 2 Drawing Sheets

ADJUSTABLE SHELF ASSEMBLY

BACKGROUND OF THE INVENTION

1. Field of the Invention

The present invention relates generally to a rotary shelf assembly which includes a rotatable vertical post supporting a plurality of shelves and more particularly to such an assembly which can be used to move the post vertically with respect to a slide member supported by a bottom wall.

2. Description of the Prior Art

Numerous shelf adjusting assemblies are known to permit vertical spacing of bearing element and to accommodate and enable the upper and lower edges of cabinet doors to be properly adjusted vertically relative to the cabinet. See for example U.S. Pat. No. 4,486,106 wherein a lower bearing element is mounted on a slide which is disposed in the lower end portion of the post for endwise movement. The slide is moved relative to the post by a cam which is disposed within the post and coacts with a cam follower on the slide. The cam is moved along the follower by a manual actuator mounted on and extending radially through the post.

For the most part, these prior art units are somewhat complicated and therefore expensive. There is a need for a simple, reliable adjustment device for such a situation that is relatively inexpensive and easy to operate. The present invention is directed to such a device and to other improvements associated with it.

SUMMARY OF THE INVENTION

A primary purpose of the present invention is to provide a rotatable post assembly of the above general type having new and improved adjusting means which enable post and door to be adjusted vertically from the lower end thereof, which involve fewer parts that may be assembled more quickly and easily with the post, and which may be assembled to the post in a more permanent manner better insuring against accidental disassembly prior to the time the post is installed in the cabinet.

Another objective of the present invention is to provide a post assembly of the type described that includes a pivotally attached bearing element engaging a lower bearing member having an upper inclined ramp that will enable the adjustment of the shelf height by manual actuation.

Yet another objective of the present invention is to provide a rotatable post assembly of the type described that utilizes a vertically moveable post utilizing an inclined ramp for adjustable engagement with a bearing member secured to the post.

Yet still another objective of the present invention is to provide a rotatable post assembly of the type described that utilizes a locking pin and a transverse slot in the lower bearing member to receive the locking pin and thereby insure the rotation of the shelves when the post is rotated whereby the slot has a height sufficient to permit upward and downward movement during post adjustment with respect to the lower bearing member.

Yet still another further objective of the present invention is to provide a rotatable post assembly of the type described that utilizes a plurality of apertures in the rotatable post and the slide member one of which becomes aligned to provide a receptacle for locking the slide member with respect to the rotatable post.

Still another further objective of the present invention is to provide a more convenient, precise and efficient adjusting screw location for manually adjusting the lower bearing member within the post.

These and other objectives of the present invention will become more apparent after a consideration of the following detailed specification taken in conjunction with the accompanying drawings wherein like characters of reference designate like parts throughout the several views.

DESCRIPTION OF THE PREFERRED EMBODIMENT

Figure 1:
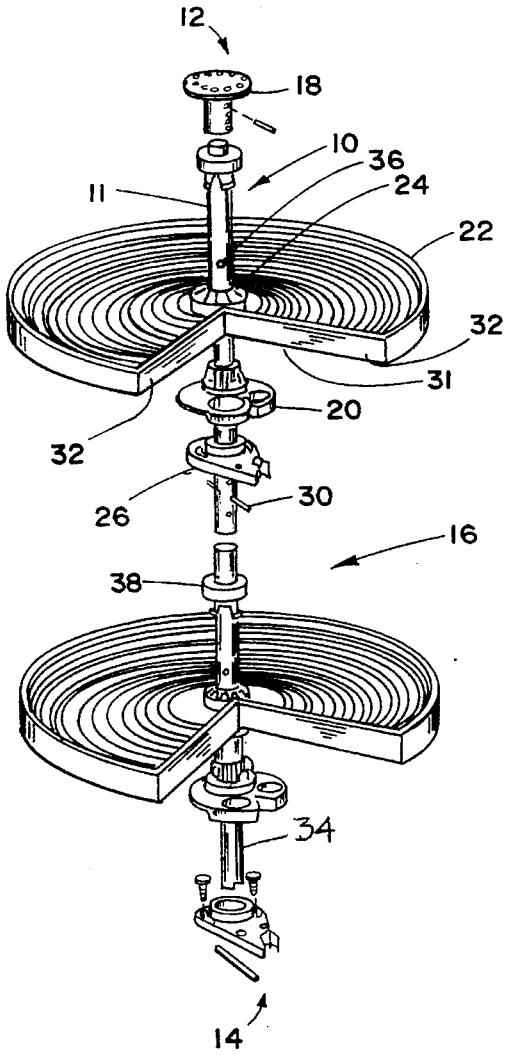
FIG. 1 is a perspective, fragmentary, partially exploded view of one embodiment of a vertical tube and its carried components of a lazy susan assembly comprising the present inventive concept.

For purposes of illustration, the shelf assembly shown generally as 10 of the present invention is illustrated in the drawings in conjunction with a corner cabinet which may be located in the corner of a room and preferably at the ends of cabinets extending along two right angled walls of the room.

The vertical post 11 extends from the top 12 to the bottom 14 of a lazy susan housing cavity 16 and supports various elements to be subsequently described. A top mounting bracket 18 is affixed to the top of the supporting cabinet and holds post 11 in a vertical position, and post 11 carries one or more shelf engaging brackets 20 which cooperatively mesh with shelf 22 at its geared hub 24. A shelf supporting positioning plate 26 cooperatively engages the shelf engaging bracket 20 and by means of a pin is secured to hold shelf 22, bracket 20 and plate 26 in a fixed relationship with each other.

The shelf arrangement described can be repeated as many times as the space within the cavity of the housing will permit. The example shown in FIG. 1 accommodates two such shelves and their related components. The shelves are adapted and rotated within the cabinet and, in order to accommodate the door, each shelf is formed with a generally pie shaped cut 31 whose rigid right angled edges 32 lie alongside the panels of the door. Fasteners secure the door rigidly to the shelves and thus the door rotates with the shelves in order to expose the front opening of the cabinet and to present the shelves to the front opening.

Figure 2:
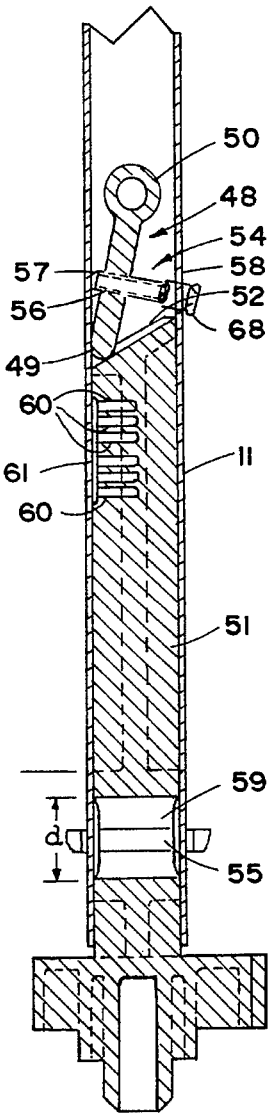
FIG. 2 is a fragmentary cross section of a vertical post similar to that shown in FIG. 1 with the post adjusted to a lowered position.
Figure 3:
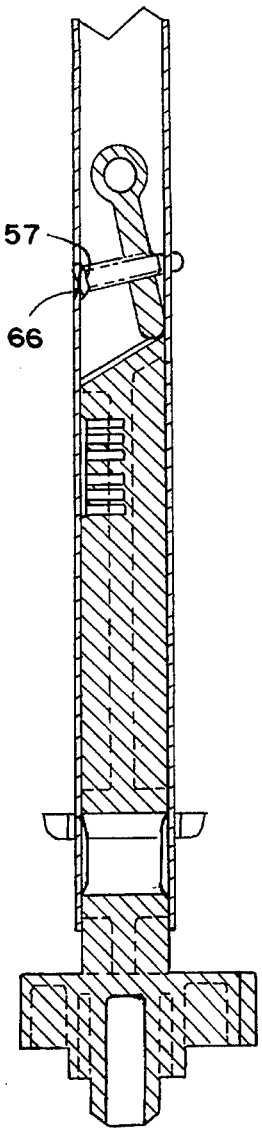
FIG. 3 is a fragmentary cross sectional view of the post of FIG. 2 showing the post adjusted to a raised position.
Figure 4:
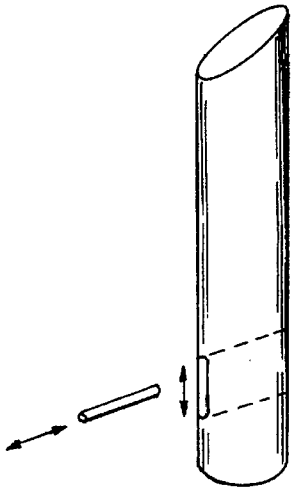
FIG. 4. is a perspective and exploded view of the lower bearing member and locking pin shown in FIGS. 2 and 3.

A precise adjustment of post 11 is necessary to enable shelves 22 and the door carried thereby to be centered between the bottom and top 12, 14 of cavity 16. Such adjustment may be provided by adjusting means as shown in FIGS. 2 and 3 which require very few parts and which may be easily and permanently secured to post 11. Moreover, the adjusting means enables shelves 22 to be assembled to post 11 by slipping the shelves along the post from either end.

The adjusting means includes a displaceable bearing member shown generally as 48 having a bearing end 49 and a pivot end 50 pivotally affixed to inner wall of post 34. Pivotal movement of the member can extend from inner wall to inner wall of the post. A lower bearing member 51 is telescoped slidably and rotatably into the lower end of post 34 and is adapted to allow upward and downward adjustment of the post with respect thereto. The upper end of member 51 has an inclined ramp 52 which engages bearing end 49 of bearing member 48 as shown in FIGS. 2 and 3. A screw 54 is threadably received in a threaded hole 56 within bearing member 48 with its forward end 57 resting against the inner wall of post 34. An elongated opening 58 in the wall of post 34 enables the screw to extend outwardly from the post making it accessible to manual adjustment by the use of a screw driver or other convenient tool. When screw 54 is tightened or turned in a clockwise direction, the bearing member is urged against inclined ramp 52 of lower bearing member 51 and thereby forces post 34 upwardly relative to slide member 51. When screw 54 is loosened or turned in a counterclockwise direction, the post moves downwardly relative to lower bearing member 51.

A slot 59 extending transversely of lower bearing member 51 and running perpendicular to its longitudinal axis is of sufficient vertical width "d" to accommodate a locking pin 55 utilized to secure the post to member 51 and ensure the rotation of the shelves and affixed door with the rotation of post 11. The vertical distance available in the slide accommodates locking pin 55 as post 11 is moved upwardly and downwardly by mechanism 48 so that the pin can remain fixed in its same position within post 11.

A plurality of apertures 60 are provided in slide member 51 in proximity with a single opening 61 in post 11 so that when opening 61 aligns with one of bearing member apertures 60, a screw or pin can be inserted to rigidly lock bearing member 51 with respect to post 11.

Because forward end 57 of bearing member 48 presses firmly against the inner wall of post 11, it has been found advantageous to strengthen that wall by forming an indentation 66 therein as shown in FIG. 3. This indentation not only strengthens the post wall but minimizes the wear associated with its continuous contact with forward end 57.

Screw 54 can also be provided with a head 68 that can be used to assist in its rotation when, for example, the shelves are unloaded. The head will also contain a slot to permit the use of a screwdriver if that is desirable.

Figure 5:
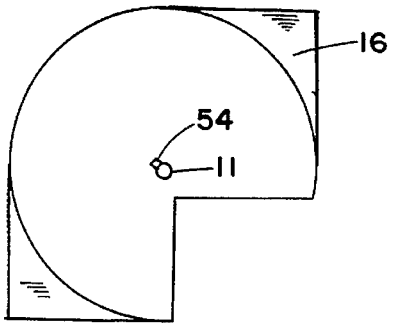
FIG. 5 is a plan view of a 90° corner cabinet wherein the door to the cabinet is cut at a 90° angle to close the cabinet opening and form a corner exterior for converging and connecting cabinets and wherein the manual adjusting means for the post assembly is positioned on the rearward side of the post thereby requiring the shelf and post to be rotated approximately 180° for the adjustment to be made.
Figure 6:
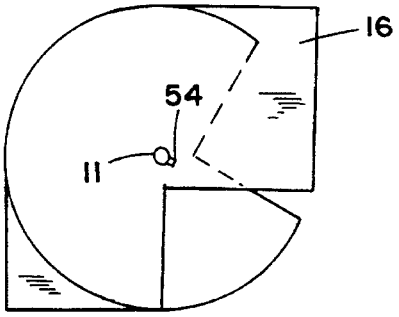
FIG. 6 is a plan view of the cabinet shown in FIG. 4 wherein the post assembly adjustment screw is positioned on the post to enable adjustment to be made when a portion of the door after rotation is still within the cabinet opening.
Figure 7:
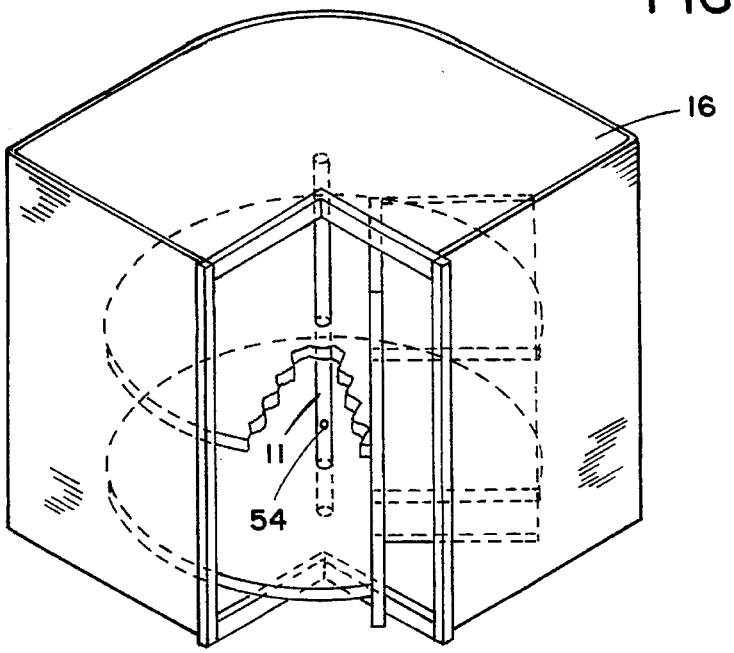
FIG. 7 is a perspective view of the cabinet shown in FIGS. 5 and 6.

Conventional means for adjusting the post and attached shelves and door to ensure complete and aesthetic closing of the door for the cabinet opening is shown in FIG. 5 wherein the adjusting screw 54 is positioned on the rearward side of post 11. This location of screw 54 is utilized by most lazy susan manufacturers but is, to an extent, inconvenient in that post 11 and attached shelves and door 22 must be rotated approximately 180° for screw 54 to be accessibly positioned at the front opening of the cabinet. With the shelves and carried door in the rearward portion of the cabinet and away from the opening, it is difficult to adjust the door to the correct height to precisely cover the opening. It may require two or three operations where the doors are positioned at the rear of the cabinet, adjustment takes place on the screw at the front of the cabinet, and doors are returned to the front of the cabinet to determine if accurate positioning to close the cabinet opening has been attained. By relocating screw 54 on post 11 as shown in FIG. 5, post 11, attached shelves 22 and the door need be rotated only a small distance—enough to ensure that a portion of the door remains within the cabinet opening. Thus the edge of the door is positioned adjacent the opening and an exact single adjustment can be made for the door to close the opening entirely.

Thus a very practical and economical post adjustment assembly has been illustrated and described. With respect to the description provided, it is to be noted that the optimum dimensional relationship to the parts of the invention, to include variations in size, materials, shape, form, function and manner of operation, assembly and use, are deemed readily apparent and obvious to one skilled in the art, and all equivalent relationship to those illustrated in the drawings and described in the specification are intended to be encompassed herein.

Therefore, the foregoing is considered as illustrative only of the principles of the invention. Further, since numerous modifications and changes will readily occur to those skilled in the art, it is not desired to limit the invention to the exact construction and operation shown and described. All suitable modifications and equivalents that fall within the scope of the appended claims are deemed within the present inventive concept.

What is claimed is:

1. A rotatable post assembly comprising: upper and lower opposing bearing members; an elongated post extending vertically between the bearing members having an upper end portion rotatably supported by said upper bearing member and a lower end portion being tubular and having inner and outer walls; a slide member having upper and lower end portions is telescoped into the lower end portion of the post; a bearing element on the lower end portion of the slide member and located below the lower end portion of the post to engage and rotatably support the lower end portion of the post; an elongated opening in the post extending in the direction of the centerline of the post; a displaceable bearing member having a bearing end and a pivot end pivotably connected to the post, the displaceable bearing member having a threaded hole therein; a screw having a forward end and a base, the forward end threaded into the threaded hole and engaging the pole inner wall and the base extending out of the elongated opening whereby tightening of the screw, forces the displaceable bearing member against an inclined surface of the upper end of the slide member and forces the post upwardly relative to the slide member while loosening the screw permits the post to move downwardly relative to the slide.

2. The assembly as claimed in claim 1 wherein the base is located outside the post outer wall.

3. The assembly as claimed in claim 1 wherein the screw forward end bears against the post inner wall and causes the displaceable bearing member to pivot at the pivot end and movably engage the slide at the bearing end.

4. The assembly as claimed in claim 3 wherein the base is located outside the post outer wall.

5. The assembly as claimed in claim 1 wherein the displaceable bearing member is retained within the inner walls of the post.

6. The assembly as claimed in claim 2 wherein the displaceable bearing member is retained within the inner walls of the post.

7. The assembly as claimed in claim 3 wherein the displaceable bearing member is retained within the inner walls of the post.

8. The assembly as claimed in claim 4 wherein the displaceable bearing member is retained within the inner walls of the post.

9. The assembly as claimed in claim 1 further comprising: one or more shelves rotatably secured to the post; a locking pin securing the at least one shelf to the post; a transverse opening in the slide member having a height sufficient to cooperatively receive the locking pin extending through the elongated post and the opening to enable unrestricted upward and downward movement by the slide member within the post while the pin is in place.

10. The assembly as claimed in claim 1 further comprising a plurality of apertures in the slide member and a single opening in the post member proximate thereto, and a pin extending through the post opening and into the most closely aligned aperture associated therewith to lock the slide member with respect to the post.

11. The assembly as claimed in claim 1 wherein the tubular end of the lower post has an indent engaging the forward end of the screw of the displaceable bearing member.

12. The assembly as claimed in claim 9 further comprising a plurality of apertures in the slide member and a single opening in the post member proximate thereto, and a pin extending through the post opening and into the most closely aligned aperture associated therewith to lock the slide member with respect to the post.

13. The assembly as claimed in claim 1 further comprising: one or more shelves rotatably secured to the post; a locking pin securing the at least one shelf to the post; a housing enclosing the post assembly; and a door affixed to at least a portion of the at least one shelf configured to selectively close a housing opening.

14. The assembly as claimed in claim 13 further comprising: a transverse opening in the slide member having a height sufficient to cooperatively receive the locking pin extending through the elongated post and the opening to enable unrestricted upward and downward movement by the slide member within the post while the pin is in place.

15. The assembly as claimed in claim 10 further comprising: one or more shelves rotatably secured to the post; a locking pin securing the at least one shelf to the post; a housing enclosing the post assembly; and a door affixed to at least a portion of the at least one shelf configured to selectively close a housing opening.

16. The assembly as claimed in claim 11 further comprising: one or more shelves rotatably secured to the post; a locking pin securing the at least one shelf to the post; a housing enclosing the post assembly; and a door affixed to at least a portion of the at least one shelf configured to selectively close a housing opening.

17. The assembly as claimed in claim 12 further comprising: a housing enclosing the post assembly; and a door affixed to at least a portion of the at least one shelf configured to selectively close a housing opening.

18. The assembly as claimed in claim 13 wherein the screw is accessibly when the door is rotated so that a portion of the door is in the housing opening.

* * * * *